US007500460B2

(12) United States Patent
Mukouhara et al.

(10) Patent No.: US 7,500,460 B2
(45) Date of Patent: Mar. 10, 2009

(54) MOUNTING STRUCTURE FOR SUPPORTING A STARTER MOTOR ON AN INTERNAL COMBUSTION ENGINE

(75) Inventors: Hodaka Mukouhara, Saitama (JP); Eiko Shiozaki, Saitama (JP); Yuichi Tawarada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 20 days.

(21) Appl. No.: 11/893,343

(22) Filed: Aug. 14, 2007

(65) Prior Publication Data

US 2008/0053397 A1 Mar. 6, 2008

(30) Foreign Application Priority Data

Aug. 30, 2006 (JP) ..... 2006-234033

(51) Int. Cl.
*F02B 75/22* (2006.01)
*F02F 7/00* (2006.01)

(52) U.S. Cl. ..... 123/195 R; 123/195 A

(58) Field of Classification Search ..... 123/195 R, 123/195 A

See application file for complete search history.

(56) References Cited

U.S. PATENT DOCUMENTS

2003/0062800 A1 4/2003 Nagai

FOREIGN PATENT DOCUMENTS

| | | |
|---|---|---|
| JP | 58-053637 | 3/1983 |
| JP | 08-177484 | 7/1996 |
| JP | 10-077936 | 3/1998 |
| JP | 2001-115933 | 4/2001 |

*Primary Examiner*—Noah Kamen
(74) *Attorney, Agent, or Firm*—Carrier, Blackman & Associates, P.C.; William D. Blackman; Joseph P. Carrier

(57) ABSTRACT

A starter-motor mounting structure is provided in a wall of an engine case, in which a front mounting boss is formed in a rear inclined surface of an inclined cylinder block portion that projects from a crankcase. A rear mounting boss is formed in a front wall surface of a raised portion where an upper wall of a transmission case is raised upwardly to accommodate a main shaft that is positioned higher than a counter shaft. The front mounting boss and the rear mounting boss are offset from each other in the crankshaft direction. Front and rear brackets of a starter motor are fastened to the front mounting boss and to the rear mounting boss, respectively. This arrangement enables a starter motor to be securely mounted to a power unit case with high rigidity, while enabling a reduction in the size of the internal combustion engine.

4 Claims, 6 Drawing Sheets

MOUNTING STRUCTURE FOR SUPPORTING A STARTER MOTOR ON AN INTERNAL COMBUSTION ENGINE

CROSS-REFERENCE TO RELATED APPLICATIONS

The present invention claims priority under 35 USC §119 based on Japanese patent application No. 2006-234033, filed on Aug. 30, 2006. The entire disclosure of this priority document, including the specification, claims, and drawings, is incorporated by reference herein.

BACKGROUND OF THE INVENTION

1. Technical Field of the Invention

The present invention relates to a structure for mounting a starter motor to an internal combustion engine in which a crankcase and a transmission case are formed integrally as a power unit case.

2. Background Art

Examples of an internal combustion engine including a power unit case for housing both an engine and transmissions according to the background art, include the motorcycle engine disclosed in Published Patent Document JP-A 2001-115933.

The power unit case of the internal combustion engine disclosed in JP-A 2001-115933, in which a crankcase and a transmission case are integrally housed, is formed so as to be separable into upper and lower halves, and has a structure with a large width in a front-to-rear direction. In the power unit case of this reference, three shafts are journaled so as to be sandwiched between horizontal parting surfaces of the power unit case halves. The three shafts include a crankshaft in a crank chamber and a main shaft and a counter shaft serving as transmission shafts in a transmission chamber, and these shafts are arranged in the order of the crankshaft, the main shaft, and the counter shaft in the front-to-rear direction.

Further, a cylinder block projects from a front side portion of the crankcase while being tilted forward, and a pair of front and rear mounting bosses are formed in the rear portion of the upper wall. A starter motor is mounted to the upper wall at the front and rear mounting bosses by fastening support arms, which are provided so as to project in a front-to-rear direction of the starter motor.

Since the crankshaft, the main shaft, and the counter shaft are arranged side by side from front to rear in the horizontal parting surface of the power unit case, the power unit case has a large front-to-rear width. Accordingly, since it is not particularly necessary to raise the upper wall of the transmission case upwardly in order to accommodate gear groups on the main shaft and the counter shaft that are arranged side by side from front to rear in the transmission chamber, the space in rear of the cylinder block and above the upper wall of the power unit case is large, and hence there is no need to take possible interference between the starter motor, mounted to the rear portion of the crankcase, and the upper wall of the transmission case into consideration.

While it is easy to mount the starter motor onto the power unit case when the power unit case has a large front-to-rear width as described above, in the case where either the main shaft or the counter shaft is moved upward, and the three described shafts are brought close to each other to reduce the front-to-rear width of the power unit case to thereby reduce the size of the internal combustion engine, the space in rear of the cylinder block and above the upper wall of the power unit case becomes narrow, the upper wall of the transmission case for accommodating groups of gears is raised upward due to the upward movement of either the main shaft and the counter shaft, and also the mounting space for the starter motor becomes restricted. It therefore becomes more problematic to securely mount the starter motor to the power unit case with high mounting rigidity in such an arrangement.

SUMMARY OF THE INVENTION

The present invention has been made in view of the above-mentioned problems, and accordingly it is an object of the present invention to provide a starter-motor mounting structure for an internal combustion engine which makes it possible to securely mount a starter motor to a power unit case with high mounting rigidity, while reducing the size of an internal combustion engine.

In order to attain the above-mentioned object, according to an aspect of the invention in a first aspect hereof, there is provided a starter-motor mounting structure for an internal combustion engine, including a starter motor mounted on a power unit case in which a crankcase for accommodating a crank mechanism and a transmission case for accommodating a transmission mechanism are integrally formed in a front-to-rear direction, wherein: a front mounting boss is formed in a rear inclined surface of a cylinder block that projects from the crankcase so as to be tilted forward; a rear mounting boss is formed in a front wall surface of a raised portion where an upper wall of the transmission case is raised upward so as to accommodate a main shaft that is positioned higher than a counter shaft of the transmission mechanism; the front mounting boss and the rear mounting boss are offset from each other in a crankshaft direction; and a front bracket and a rear bracket that extend from the starter motor are respectively fastened to the front mounting boss and the rear mounting boss.

According to a second aspect of the invention, in addition to the starter-motor mounting structure for an internal combustion engine according to the first aspect, the front mounting boss is formed at a position that is offset, in an axial direction of the crankshaft, from a cylinder center axis.

According to a third aspect of the invention in addition to the starter-motor mounting structure for an internal combustion engine according to the first aspect, a group of gears is accommodated in the raised portion of the upper wall of the transmission case, the group of gears including a plurality of gears of different diameters arranged on the main shaft inside the transmission case, and the rear mounting boss is formed at a position opposed to a small-diameter gear from among the group of gears.

According to another aspect of the invention, in addition to the starter-motor mounting structure for an internal combustion engine according to the first aspect, the rear mounting boss is formed in an upwardly extending portion of a partition wall that partitions between a crank chamber inside the crankcase and a transmission chamber inside the transmission case.

According to the starter-motor mounting structure for an internal combustion engine of the first aspect hereof, the starter-motor mounting structure has the raised portion where the upper wall of the transmission case is raised upward so as to accommodate the main shaft that is positioned higher than the counter shaft, and the crankshaft, the main shaft, and the counter shaft are brought close to each other to achieve a reduction in the size of the internal combustion engine. Despite such an arrangement, since the front mounting boss, which is formed in the rear inclined surface of the cylinder block that projects from the crankcase so as to be tilted forward, and the rear mounting boss, which is formed in the front wall surface of the raised portion where the upper wall of the transmission case is raised upward, are offset from each other in the crankshaft direction, the distance between the front mounting boss and the rear mounting boss can be set large. Since the front bracket and the rear bracket that extend from the starter motor are fastened to the front mounting boss and the rear mounting boss that are thus arranged at a suitable spacing from each other, a high mounting rigidity is secured, and the influence of vibration acceleration exerted on the starter motor by the vibration of the internal combustion engine is reduced, thereby making it possible to enhance the durability of the starter motor.

According to the starter-motor mounting structure for an internal combustion engine in the second aspect, the front mounting boss is formed at a position that is offset from the cylinder center axis in the crankshaft direction. This means that the front mounting boss is formed at a location with the highest rigidity where a stud bolt or the like for fastening the cylinder head is arranged, thereby making it possible to enhance the rigidity of the front mounting boss itself. Further, the front mounting boss can be formed so as to be positioned further forward while avoiding the cylinder bore, that is, so as to be positioned as far forward as possible from the rear mounting boss, thereby making it possible to secure higher mounting rigidity by increasing the distance between the front mounting boss and the rear mounting boss.

According to the starter-motor mounting structure for an internal combustion engine in the third aspect, the rear mounting boss, which is formed in the front wall surface of the raised portion of the upper portion of the transmission case accommodating a group of gears including a plurality of gears of different diameters arranged on the main shaft, is formed at a position opposed to a small-diameter gear from among the group of gears. Therefore, the rear mounting boss can be formed so as to be positioned further rearward in proximity to the small-diameter gear, that is, so as to be positioned as far rearward as possible from the front mounting boss, thereby making it possible to further increase the distance between the front mounting boss and the rear mounting boss to secure higher mounting rigidity.

According to the starter-motor mounting structure for an internal combustion engine in the fourth aspect hereof, the rear mounting boss formed in the front wall surface of the raised portion of the transmission case is formed in the upwardly extending portion of the partition wall, which partitions between the crank chamber and the transmission chamber and represents a portion of the transmission case having a particularly high rigidity, thereby making it possible to enhance the rigidity of the rear mounting boss itself.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the art.

A selected illustrative embodiment of the present invention will now be described, with reference to FIGS. 1 to 7. An internal combustion engine E according to this embodiment is a four-cylinder, four-stroke water-cooled engine in which four cylinders are arranged in an in-line series. The internal combustion engine E is horizontally mounted in a motorcycle with a crankshaft 10 thereof extending in the left-to-right direction.

It should be noted that in this specification, relative positional terms such as front, rear, left and right are considered from a vantage point of a driver seated on the motorcycle and facing forward.

Figure 1:
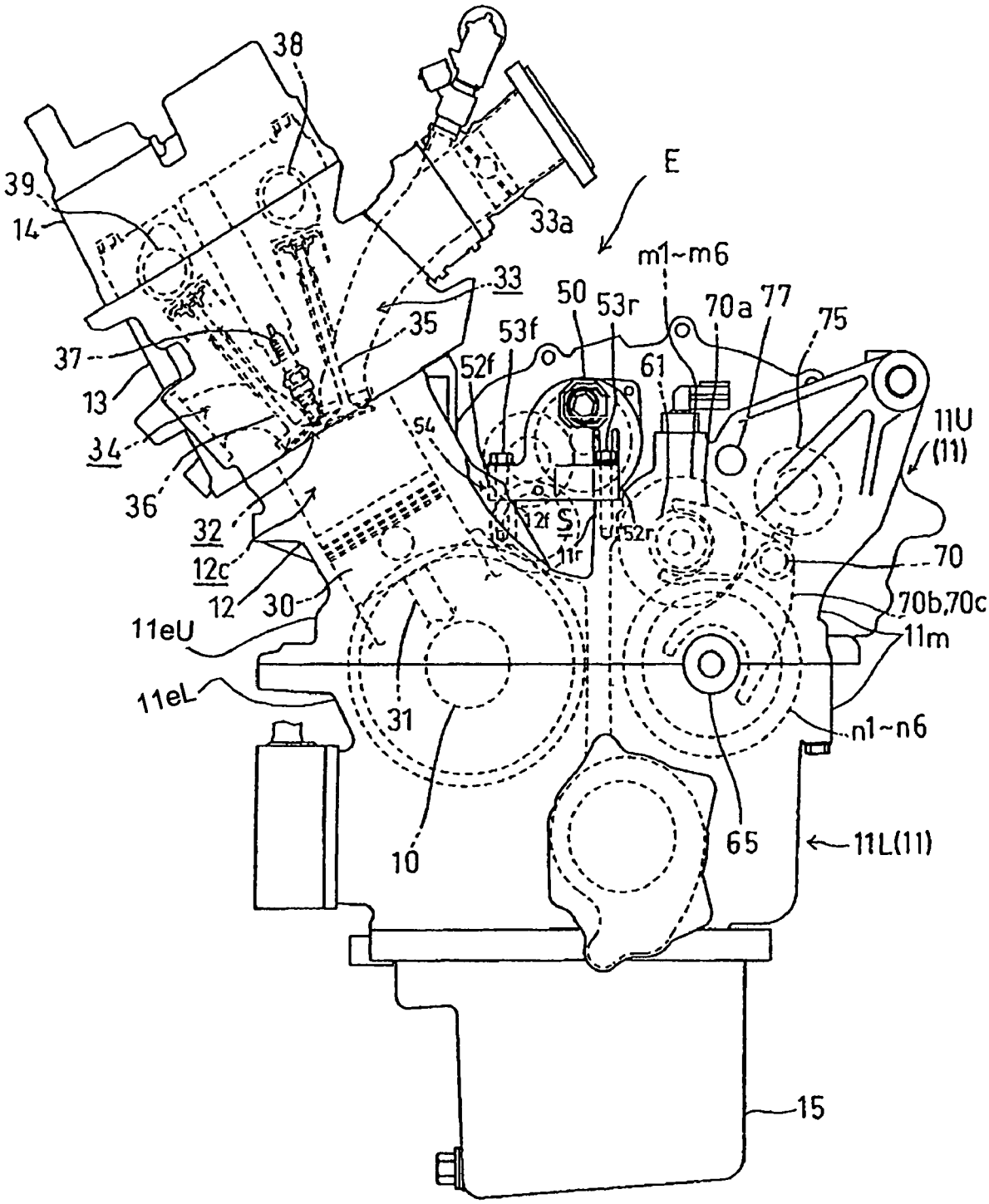
FIG. 1 is a left plan view of an internal combustion engine according to a selected illustrative embodiment of the present invention, with some internal engine components shown in phantom.

A left view of the internal combustion engine E is shown in FIG. 1. In the internal combustion engine E, a crankcase 11*e* that forms a crank chamber C for accommodating the crankshaft 10, and a transmission case 11*m* that forms a transmission chamber M for accommodating a transmission mechanism 60 are integrally formed in the front-to-rear direction to constitute a powertrain case or unit case 11.

The power unit case 11 is formed so as to be divided into an upper unit case 11U and a lower unit case 11L.

In an upper portion of the upper crankcase 11*e*U, a cylinder block portion 12, molded integrally to form four serially arranged cylinder bores 12*c* therein, extends upwardly while simultaneously being somewhat forwardly inclined. A cylinder head 13 is laid on top of the cylinder block portion 12, and a cylinder head cover 14 is placed on top of the cylinder head 13.

On the other hand, an oil pan 15 is mounted below the lower unit case 11L.

A piston 30 is fitted in each of the cylinder bores 12*c* of the four cylinders of the cylinder block portion 12, so as to be capable of reciprocating sliding motion. Each piston 30 is connected to the crankshaft 10 via a respective connecting rod 31.

A combustion chamber 32 is formed in the cylinder head 13 for each of the cylinder bores 12*c*, so as to be opposed to the piston 30. An intake port 33, which is open to the combustion chamber 32 and opened and closed by a pair of intake valves 35, extends rearward, an exhaust port 34 opened and closed by a pair of exhaust valves 36 extends forward, and a spark plug 37 is inserted into the cylinder head with a tip portion of the spark plug facing the combustion chamber 32.

A throttle body 33*a* is connected to an upstream intake passage pipe 33*b* of the intake port 33 and, although not shown, an intake duct is connected to the upstream side thereof, and an exhaust pipe is connected to a downstream opening of the exhaust port 34.

Each of the intake valves 35 and each of the exhaust valves 36 are driven so as to open and close by an intake camshaft 38 and an exhaust camshaft 39, which are rotatably journalled to the cylinder head 13, in synchronism with the rotation of the crankshaft 10.

For this reason, cam sprockets 38*s*, 39*s* are fitted into the right end portions of the respective camshafts 38,39. A timing chain 40 is wound between a drive sprocket 10*s*, which is fitted into a portion near the right end portion of the crankshaft 10, and each of the cam sprockets 38*s*, 39*s* (see FIG. 2), and is rotationally driven at half the rotational speed of the crankshaft 10.

Figure 2:
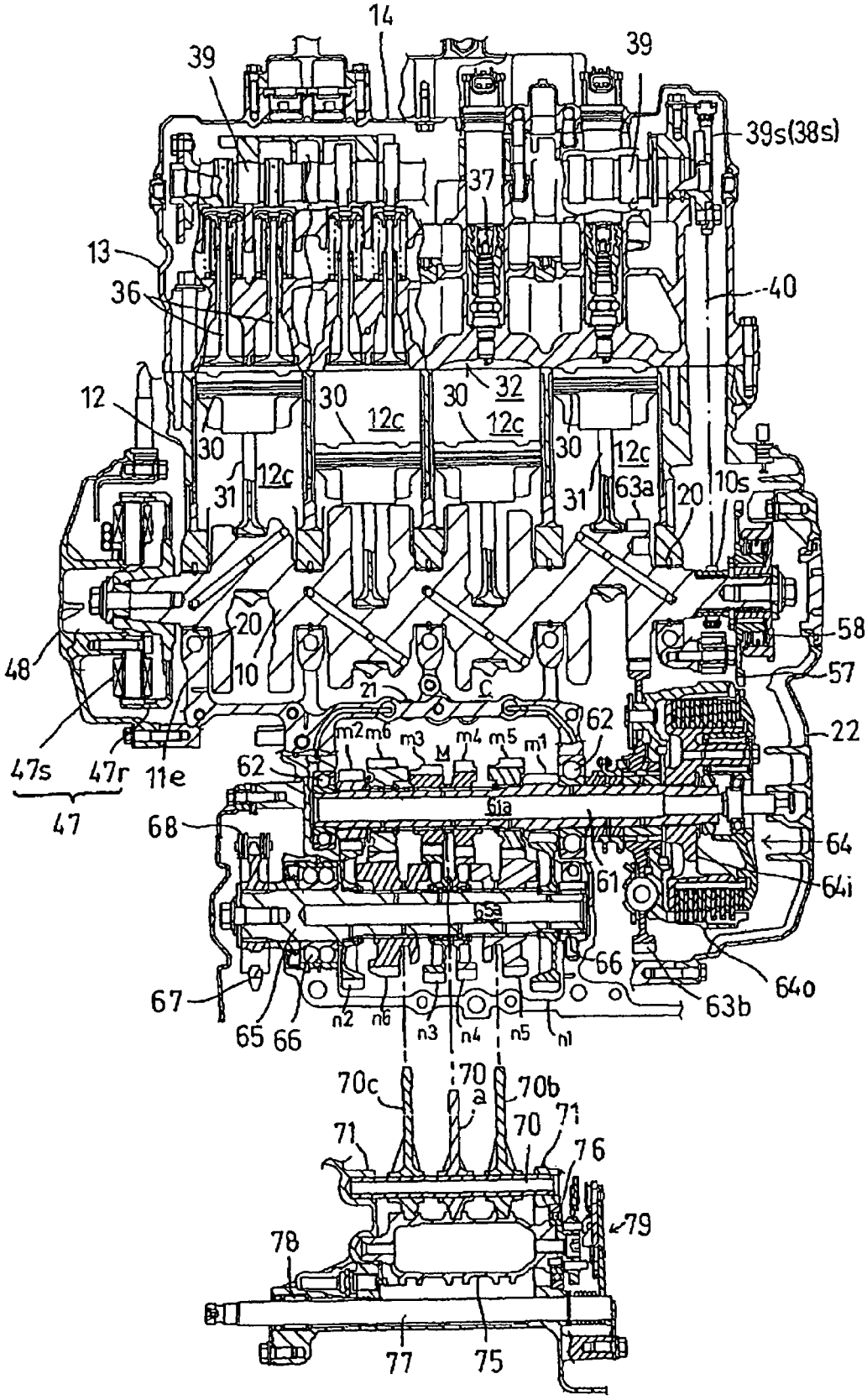
FIG. 2 is an exploded sectional view of the internal combustion engine of FIG. 1.

The crankshaft 10 is rotatably journalled while being sandwiched between the upper and lower crankcases 11*eu*, 11*el* via a main bearing 20. As shown in FIG. 2, in the right portion of the crankshaft 10, a starting driven gear 57 is journalled via a one-way clutch 58 to an end portion located on the further right side with respect to the driven sprocket 10*s* fitted as described above.

As shown in FIG. 2, an outer rotor 47*r* of an AC generator 47 is fitted into the left end portion of the crankshaft 10 extending through the left wall of the crankcase 11*e*. An inner stator 47*s* of the AC generator 47 which includes a generator coil is arranged inside the outer rotor 47*r* while being supported on a generator cover 48 that is covered to the AC generator 47 from the left.

Figure 6:
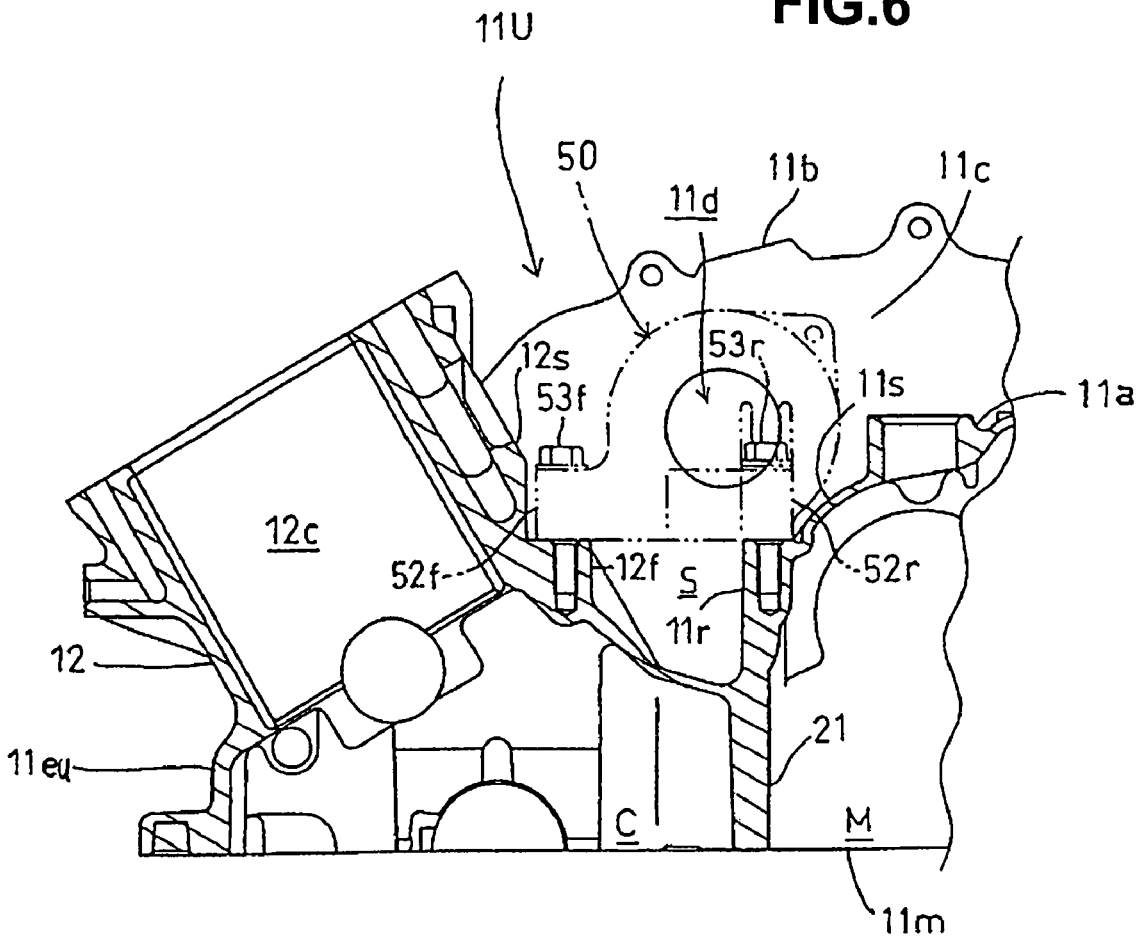
FIG. 6 is a cross-sectional view of the upper unit case of FIG. 3, taken along the line VI-VI of FIG. 3.
Figure 7:
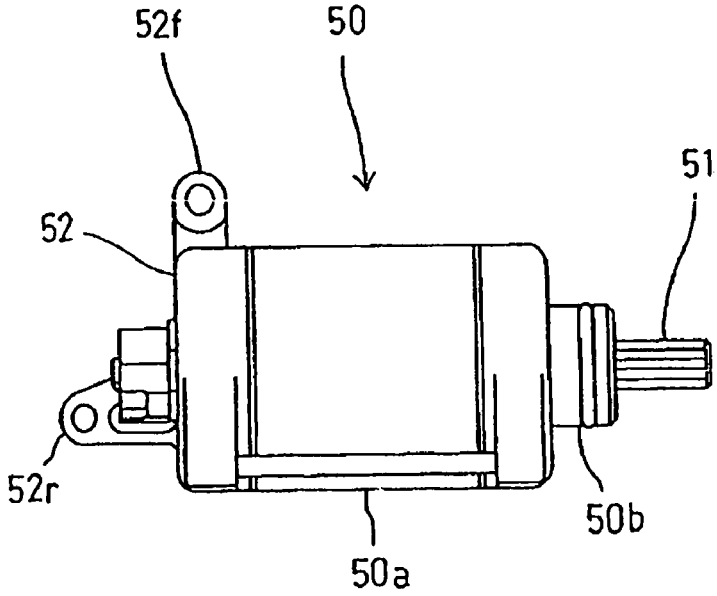
FIG. 7 is a top view of a starter motor, which is another component of the internal combustion engine of FIGS. 1-2.

The transmission chamber M, which is partitioned off by the crank chamber C of the crankcase 11*e* accommodating the crankshaft 10, and a partition wall 21, is formed on the rear side in the transmission case 11*m* (see FIG. 2 and FIG. 6).

The transmission mechanism 60 accommodated in the transmission chamber M is a constant-mesh gear transmission. At a position in rear of and obliquely above the crankshaft 10, a main shaft 61 is rotatably journalled via bearings 62, 62 to left and right bearing portions 62*a*, 62*a* of the upper transmission case 11*m*, and at a position in rear of the crankshaft 10, a counter shaft 65 is rotatably journalled via bearings 66, 66 while being sandwiched between semi-arcuate bearing portions 66*a*, 66*a* formed in the parting surface between the upper- and lower transmission cases 11*m*, 11*m*.

The main shaft 61 is arranged above the space between the crankshaft 10 and the counter shaft 65 arranged at a position substantially horizontally in rear of the crankshaft 10. The crankshaft 10, the main shaft 61, and the counter shaft 65 are parallel to each other while being oriented in the left-to-right, horizontal direction. As seen in side view, these shafts are positioned at the corners of an acute-angled triangle and compactly brought together, thereby achieving a reduction in the size of the power unit case 11.

Six transmission gears m1 to m6 with gear ratios ranging from first to sixth are journalled to the main shaft 61 inside the transmission chamber M. Transmission gears n1 to n6 corresponding to the transmission gears m1 to m6 are journalled to the counter shaft 65, and the corresponding transmission gear pairs are in mesh with each other.

Referring to FIG. 2, the meshing between gears with the largest gear ratio, the first-speed gears m1, n1, is positioned on the rightmost side along the right wall of the transmission chamber M, the meshing between the second-speed gears m2, n2 is positioned on the leftmost side along the left wall of the transmission chamber M, and the meshing between the third-speed gears m3, n3, between the fourth-speed gears m4, n4, between the fifth-speed gears m5, n5, and between the sixth-speed gears m6, n6 are positioned between the first-speed gears m1, n1, and the second-speed gears m2, n2.

Of these, the third-speed gear m3 and the fourth-speed gear m4 on the main shaft 61 are integrally spline-fitted to the main shaft 61 and act as a shifter to move axially so as to be capable of selectively engaging with or disengaging from the sixth-speed gear m6 and the fifth-speed gear m5 on the left and right, and the fifth-speed gear n5 and the sixth-speed gear n6 on the counter shaft 65 are integrally spline-fitted to the counter shaft 65 and act as a shifter to move axially so as to be capable of selectively engaging with or disengaging from the transmission gears on the left and right of the fifth-speed gear n5 and the sixth-speed gear n6.

The integrated structure of the third-speed gear m3 and the fourth-speed gear m4 on the main shaft 61, and the integrated structure of the fifth-speed gear n5 and the six-speed gear n6 on the counter shaft 65, which each serve as a shifter, are moved by a gear shift operation mechanism to effect a gear shift.

Figure 5:
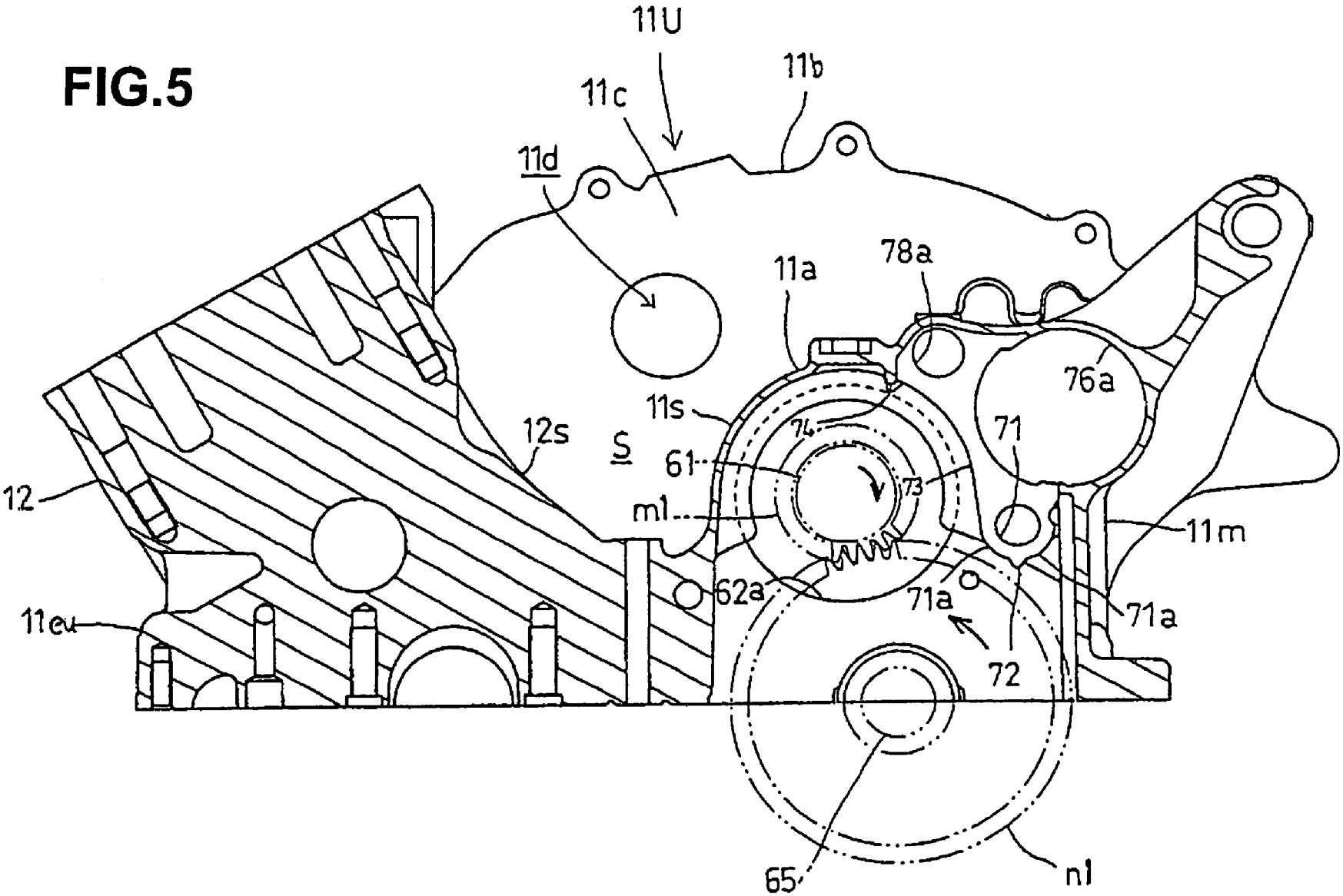
FIG. 5 is a cross-sectional view of the upper unit case of FIG. 3, taken along the line V-V of FIG. 3.

Referring to FIGS. 1 and 5, in the gear shift operation mechanism, a shift fork shaft 70 is supported in rear of the main shaft 61 with its both ends fitted into left and right bearing portions 71, 71 of the upper transmission case 11*m*. Above the shift fork shaft 70, a shift drum 75 is rotatably journalled to left and right bearing portions 76*a*, 76*a* of the upper transmission case 11*m* via bearings 76, 76.

Further, at a position in front of and slightly obliquely above the shift drum 75, a shift spindle 77 is rotatably journalled to left and right bearing portions 78*a*, 78*a* of the upper transmission case 11*m* via a bearing 78.

Referring to FIG. 2, respective shift pins of shift forks 70*a*, 79*b*, 70*c* slidably supported on the shift fork shaft 70 are fitted in three shift grooves formed in the outer peripheral surface of the shift drum 75. As the shift drum 75 turns, the shift fork 70*a*, which axially moves while being guided along the shift groove, causes the third-speed gear m3 and the fourth-speed gear m4 on the main shaft 61 to move, and the shift forks 70*b*, 70*c* respectively cause the fifth-speed gear n5 and the sixth-speed gear n6 on the counter shaft 65 to move, thereby effectively changing the transmission gear pair that transmits power.

It should be noted that the shift drum 75 turns as the rotation of the shift spindle 77 by a required angle is transmitted via a link mechanism 79.

A multiple-disc friction clutch 64 is provided to the right end portion of the main shaft 61 projecting from the transmission chamber M. A primary driven gear 63*b*, which is supported on a large-diameter clutch outer 64*o* of the friction clutch 64 so as to rotate therewith, and a primary drive gear 63*a* formed in a crank web located on the rightmost side of the crankshaft 10 are brought into meshing engagement with other, thereby forming a primary speed-reduction mechanism.

A clutch inner 64*i* located on the output side of the friction clutch 64 is spline-fitted to the main shaft 61. The rotation of the crankshaft 10 is thus transmitted to the main shaft 61 via the primary speed-reduction mechanism 63*a*, 63*b* and the friction clutch 64.

A right case cover 22 is placed so as to cover the large-diameter friction clutch 64 at the right end of the main shaft 61, and the one-way clutch 58 at the right end of the crankshaft 10, from the right side.

As mentioned above, the rotation of the main shaft 61 is transmitted to the counter shaft 65 through the meshing engagement between the transmission gears m1 to m6 and the transmission gears n1 to n6.

The counter shaft 65 also serves as an output shaft, and an output sprocket 67 is fitted into a left end portion of the counter shaft 65 which extends through the power unit case 11 to project outward. A driving chain 68 is wound between the output sprocket 67 and a driven sprocket (not shown) of a rear wheel, thereby forming a secondary speed-reduction mechanism. Power is transmitted to the rear wheel via the secondary speed-reduction mechanism.

Since the transmission mechanism 60 and the large-diameter friction clutch 64 are constructed as described above, in the upper unit case 11U that covers these components from above, an upper wall of the rear transmission case 11*m* is raised upward so as to cover the transmission gears m1 to m6 journalled to the main shaft 61, and the shift drum 75, forming a raised portion 11*a* (FIG. 5).

Accordingly, as shown in FIG. 5, a rear inclined surface 12*s* of the cylinder block portion 12 that is tilted forward, and a front wall surface 11*s* of the raised portion 11*a* are in a substantially V-shaped formation.

Further, the right side of the upper unit case 11U forms an enlarged portion 11*b* that largely juts out upwardly, and has a left wall 11*c* so as to accommodate a starting speed-reduction gear mechanism 54 for transmitting the drives by the large-diameter friction clutch 64 and a starter motor 50 that will be described later (see FIG. 5).

It should be noted that the right side of the enlarged portion 11*b* is covered by the right case cover 22.

Accordingly, as shown in FIGS. 5 and 6, a V-shaped space S is formed extending in a front-to-rear direction on the left side of the left wall 11*c* of the enlarged portion 11*b* that is on the right side of the upper unit case 11U. The V-shaped space S is defined by the rear inclined surface 12*s* of the cylinder block portion 12 and the front wall surface 11*s* of the raised portion 11*a*. The starter motor 50 is disposed in this V-shaped space S.

A circular hole 11*d*, into which a drive shaft 50*a* of the starter motor 50 is inserted, is bored in the left wall 11*c* of the enlarged portion 11*b*. A front mounting boss 12*f* is formed in the rear inclined surface 12*s* of the cylinder block portion 12. A rear mounting boss 11*r* is formed in the front wall surface 11*s* of the raised portion 11*a*.

Figure 3:
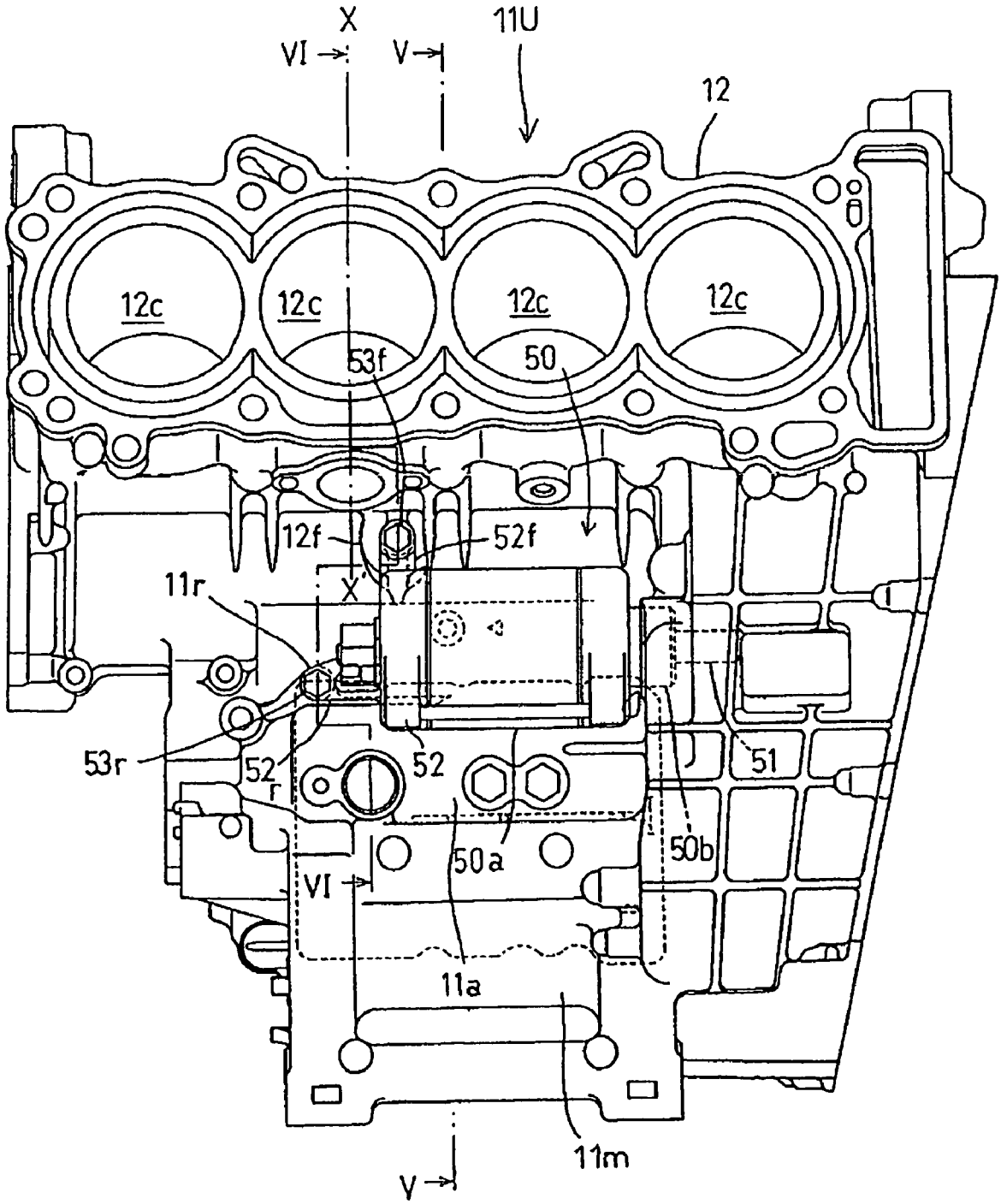
FIG. 3 is a top plan view of an upper unit case, which is a component of the internal combustion engine of FIGS. 1-2.

Referring to FIG. 3 that is an upper perspective view of the upper unit case 11U, the front mounting boss 12*f* is formed in the rear inclined surface 12*s* behind the cylinder bore 12*c* that is located second from the left from among the four cylinder bores 12*c* arranged in series in the left-to-right direction, and at a position that is offset to the right side in the crankshaft direction from the cylinder center axis X-X' of the cylinder bore 12*c* located second from the left.

On the other hand, the rear mounting boss 11*r* is formed in the front wall surface 11*s* of the raised portion 11*a*, and on the left side in the crankshaft direction with respect to the cylinder center axis X-X' of the above-mentioned cylinder bore 12*c* located second from the left (see FIG. 3).

Accordingly, the front mounting boss 12*f* and the rear mounting boss 11*r* are offset from each other in the axial direction of the crankshaft (see FIG. 3).

Further, as shown in FIGS. 1 and 6, the mounting seat surface of the front mounting boss 12*f* and the mounting seat surface of the rear mounting boss 11*r* are located at the same height as the parting surface of the power unit case 11.

The starter motor 50 is mounted to the front mounting boss 12*f* and the rear mounting boss 11*r*.

The starter motor 50 has its substantially cylindrical main body portion 50*a* placed on the upper unit case 11U as shown in FIG. 3. A bearing cylinder portion 50*b* projects from the right end face of the main body portion 50*a*, and a motor drive shaft 51 projects from the bearing cylinder portion 50*b* (see FIG. 7).

A mounting member 52 is fitted onto the left end portion of the main body portion 50*a*. A front bracket 52*f* extends forward from the lower front portion of the mounting member 52, and a rear bracket 52*r* extends to the left from the lower rear portion thereof (see FIGS. 3, 7).

In the starter motor 50, in the V-shaped space S located on the left side of the left wall 11*c* of the enlarged portion 11*b* on the right side of the upper unit case 11U and formed by the rear inclined surface 12*s* of the cylinder block portion 12 and the front wall surface 11*s* of the raised portion 11*a*, the motor drive shaft 51 is inserted through the circular hole 11*d* bored in the left wall 11*c*, thereby fitting the bearing cylinder portion 50*b*, which projects from the right end face of the main body, in the circular hole 11*d*. The forwardly extending front bracket 52*f* of the mounting member 52 at the left end of the main body is placed on the mounting seat of the front mounting boss 12*f* and fastened with a bolt 53*f*, and the rear bracket 52*r* that extends to the left is placed on the mounting seat of the rear mounting boss 11*r* and fastened with a bolt 53*r*. The starter motor 50 is thus mounted onto the upper unit case 11U as shown in FIG. 3.

Accordingly, the starter motor 50 is mounted so as to be suspended in the V-shaped space S formed by the rear inclined surface 12*s* of the cylinder block portion 12 and the front wall surface 11*s* of the raised portion 11*a*, with the bearing cylinder portion 50*b* at the right end of the starter motor 50 fitted in the circular hole 11*d* of the left wall 11*c* of the enlarged portion 11*b*, and with the mounting member 52 at the left end of the starter motor 50 fastened to the front mounting boss 12*f* and the rear mounting boss 11*r*.

The motor drive shaft 51 of the starter motor 50 is inserted in the circular hole 11*d* of the left wall 11*c* of the enlarged portion 11*b*, and a drive gear formed at the distal end portion of the motor drive shaft 51 is gear-coupled to the starting driven gear 57 of the crankshaft 10 via the starting speed-reduction gear mechanism 54.

Accordingly, when the starter motor 50 is driven and the motor drive shaft 51 rotates, the rotation is transmitted to the starting driven gear 57 via the starting speed-reduction gear mechanism 54, and the rotation of the starting driven gear 57 is transmitted to the crankshaft 10 via the one-way clutch 58, thereby starting the internal combustion engine E through forcible rotation of the crankshaft 10.

Figure 4:
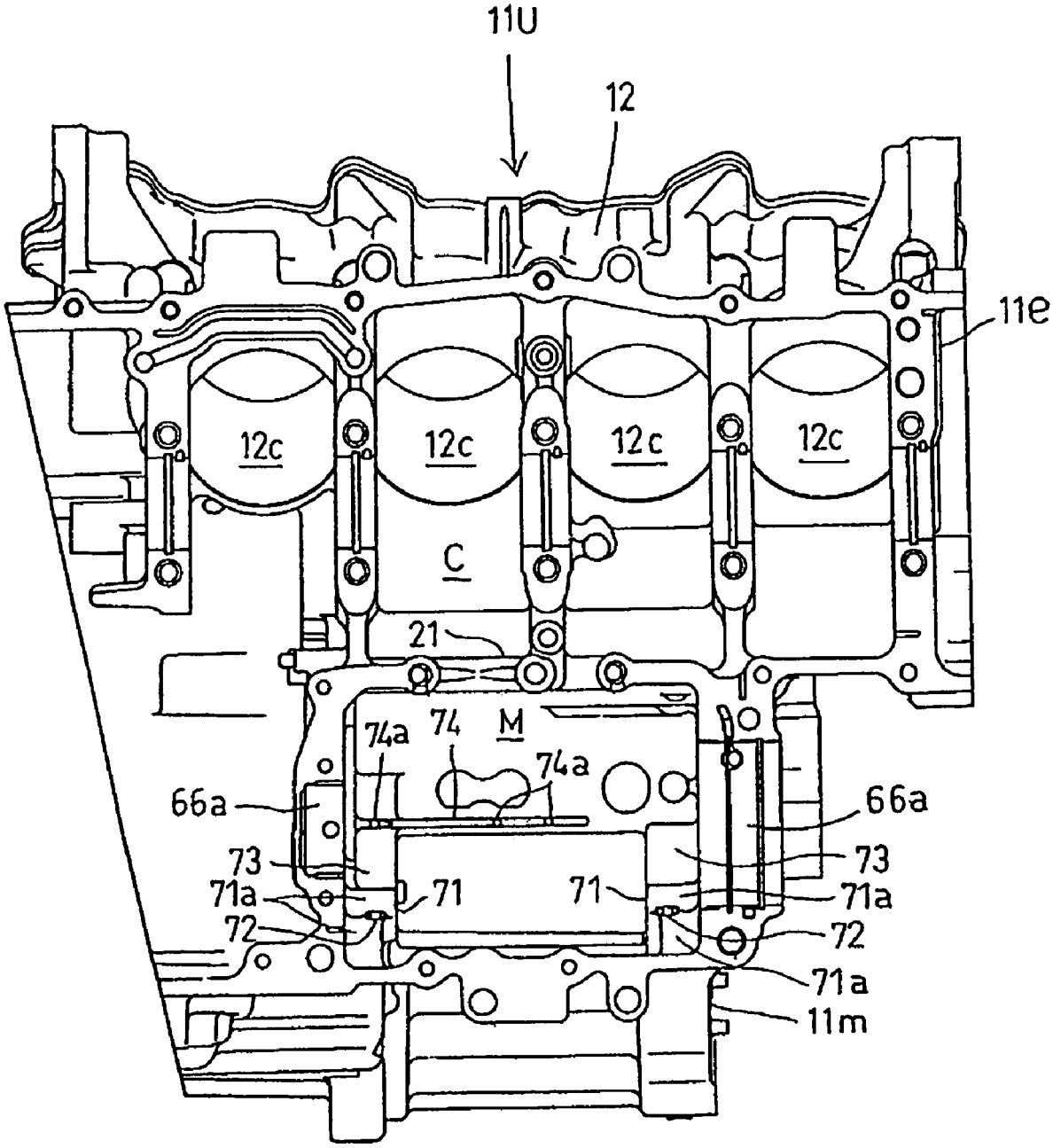
FIG. 4 is a bottom plan view of the upper unit case of FIG. 3.

Referring to FIGS. 4 and 5, in the internal combustion engine E as described above, in the inner surface of the raised portion 11*a* of the transmission case 11*m* of the upper unit case 11U, that is, in the ceiling surface of the transmission chamber M, lubricating projections 72, 72 are formed so as to project downward from the left and right bearing portions 71, 71 into which the right end of the shift fork shaft 70 is fitted and supported.

The lubricating projection 72 on the right side is formed above the first-speed gear n1 on the rightmost side which is journalled to the counter shaft 65 inside the transmission chamber M.

As shown in FIG. 5, the right bearing portion 71 of the shift fork shaft 70 is located at the downwardly-hanging lower end portion on the rear side of an arcuate ceiling surface 73 along the first-speed gear m1 on the rightmost side which is journalled to the main shaft 61. The lower surface of the right bearing portion 71 at the lower end portion forms an arcuate surface 71*a*, and the lowermost portion of the arcuate surface 71*a* projects further downward to form the lubricating projection 72.

In the right bearing portion 71 of the shift fork shaft 70, the front side of the lubricating projection 72 forms a front-half arcuate surface 71*a* that is continuous to the arcuate ceiling surface 73. Likewise, the rear side of the lubricating projection 72 forms a rear-half arcuate surface 71*a*.

The left bearing portion 71 of the shift fork shaft 70 is shaped similarly. The left lubricating projection 72 is similarly formed so as to project downward from the left bearing portion 71.

Referring to FIGS. 4 and 5, in the ceiling surface of the transmission chamber M, a rib 74 is formed so as to project downward while being oriented in the axial direction (left-to-right direction), at a position that is slightly shifted to the rear from a location vertically above the main shaft 61.

The rib 74 is formed above the transmission gears m1, m3 to m6 journalled to the main shaft 61. The rib 74 has downwardly-projecting protrusions 74*a* formed at its several axial locations to drip lubricating oil to locations where the supply of lubricating oil tends to become particularly thin, thereby enhancing lubrication.

Hollow lubricating-oil passages 61*a*, 65*a* are formed around the axial centers of the main shaft 61 and counter shaft 65. Lubricating oil is ejected radially from oil holes formed at several locations of the lubricating-oil passages 61*a*, 65*a*. The lubricating oil lubricates the axial movement of the shifter gear that is spline-fitted to the main shaft 61 and the counter shaft 65, and is thrown upward by the rotation of the groups of transmission gears m1 to m6, n1 to n6 inside the transmission chamber. The lubricating oil thus thrown upward adheres onto the ceiling surface of the transmission chamber M, and is dripped onto the groups of transmission gears m1 to m6, n1 to n6, thereby lubricating the meshing engagement between the groups of transmission gears m1 to m6, n1 to n6.

The power unit case structure according to the present invention is a structure with a reduced front-to-rear width, in which the crankshaft 10 and the counter shaft 65 are rotatably journalled while being sandwiched between substantially horizontal parting surfaces of the upper and lower unit case halves, and the main shaft 61 is rotatably journalled above the space between the crankshaft 10 and the counter shaft 65 and at a position above and slightly in front of the counter shaft 65. As seen in the left view shown in FIG. 5, the main shaft 61 rotates clockwise (as indicated by an arrow in FIG. 5) as the rotation of the crankshaft 10 is transmitted to the main shaft 61 via the primary speed-reduction mechanism 63*a*, 63*b*, and the counter shaft 65 rotates counterclockwise (as indicated by an arrow in FIG. 5) due to the meshing engagement between the groups of transmission gears m1 to m6, n1 to n6.

In the inner surface of the transmission case 11*m* of the upper unit case 11U (the ceiling surface of the transmission chamber M) in the power unit case structure according to the present invention, the rib 74 is formed so as to project downward while being oriented in the axial direction, at a position that is slightly shifted to the rear from a location vertically above the main shaft 61. Accordingly, the lubricating oil thrown upward by the clockwise rotation of the transmission gears m1 to m6 journalled to the main shaft 61 is temporarily received by the rib 74, which is formed at the position that is shifted to the rear from the location vertically above the main shaft 61. The lubricating oil is then dripped to the portions of the transmission gears m1 to m6 rotating downward (immediately before the meshing engagement between the respective transmission gears m1 to m6, n1 to n6 of the main shaft 61 and counter shaft 65). The lubricating oil is thus efficiently fed to meshing portions between the groups of transmission gears m1 to m6, n1 to n6, thus lubricating the meshing portions.

Further, of the first transmission gears m1, n1 as the combination of gears that provides the largest gear ratio, the first transmission gear m1 located on the upper side and journalled to the main shaft 61 is surrounded by the arcuate ceiling surface 73, and the right bearing portion 71 of the shift fork shaft 70 hangs downward above the first transmission gear n1 located on the lower side and journalled to the counter shaft 65. In the arcuate surface 71*a* of the right bearing portion 71, the lubricating projection 72 is formed so as to project downward.

Further, the second transmission gear m2 of the combination of the second transmission gears m2, n2 that provides the second largest gear ratio is similarly surrounded by the arcuate ceiling surface 73, and the left bearing portion 71 of the shift fork shaft 70 hangs downward above the second transmission gear n2 located on the lower side and journalled to the counter shaft 65. In the arcuate surface 71*a* of the left bearing portion 71, the lubricating projection 72 is formed so as to project downward.

The shift fork shaft 70 constitutes gear ratio selecting means closest to both the groups of transmission gears m1 to m6, n1 to n6. Therefore, both the bearing portions 71, 71 supporting the shift fork shaft 70 are respectively located near the first transmission gear n1 and the second transmission gear n2, and the lubricating protrusions 72, 72 formed so as to project downward from the arcuate surfaces 71*a*, 71*a* of the bearing portions 71, 71 are respectively located in close proximity to and above the first transmission gear n1 and the second transmission gear n2.

Accordingly, in particular, the lubricating oil that has been thrown upward by the rotation of the first transmission gear m1 and second transmission gear m2 journalled to the main shaft 61, and has adhered onto the arcuate ceiling surfaces 73, 73 travels along the rear ceiling surfaces 73, 73 and travels continuously to the front-half arcuate surfaces 71*a*, 71*a* of the bearing portions 71, 71 to reach the lubricating projections 72, 72. The lubricating oil is then dripped directly below from the lubricating projections 72, 72 onto the first transmission gear n1 and the second transmission gear n2 (that are journalled to the counter shaft 65).

Further, the lubricating oil thrown upward by the rotation of the first transmission gear n1 and second transmission gear n2 adheres onto the rear-half arcuate surfaces 71*a*, 71*a* of the bearing portions 71, 71, and travels along the rear-half arcuate surfaces 71*a*, 71*a* to be dripped directly below from the lubricating projections 72, 72 onto the first transmission gear n1 and the second transmission gear n2.

As described above, in the power unit case structure according to the present invention, the main shaft 61 is arranged above the space between the crankshaft 10 and the counter shaft 65 that are arranged in the substantially horizontal parting surface between the upper and lower unit case halves, thereby achieving a reduction in front-to-rear width and hence a reduction in the size of the internal combustion engine E. In the upper unit case 11U of the above-mentioned structure, the lubricating projections 72, 72 are respectively provided above the first transmission gear n1 and the second transmission gear n2, and the lubricating oil that has traveled along the front and rear arcuate surfaces 71*a*, 71*a* of the lubricating projections 72, 72 is dripped directly below to the upper portion of the first transmission gear n1 rotating toward the meshing portion of the first transmission gears m1, n1, and to the upper portion of the second transmission gear n2 rotating toward the meshing portion of the second transmission gears m2, n2. The lubricating oil is thus efficiently dripped for supply, in particular to the meshing portion of the first transmission gears m1, n1 that provide the largest gear ratio, and it is possible to positively lubricate the meshing portions of the first transmission gears m1, n1 and second transmission gears m2, n2 on which large loads act, thereby securing appropriate lubrication performance.

Further, the lubricating oil thrown up by the rotation of the group of transmission gears m1 to m6 journalled to the main shaft 61 is temporarily received by the rib 74, and then the lubricating oil is dripped to the upper portion of the group of transmission gears m1 to m6 rotating toward the meshing portion between the groups of transmission gears m1 to m6, n1 to n6 and supplied to this meshing portion. Further, the lubricating oil that has scattered and adhered onto the ceiling surface due to the rotations of the transmission gears m1, m2 and of the transmission gears n1, n2 journalled to the counter shaft 65 can be collected by the lubricating projections 72, 72 for dripping onto the transmission gears n1, n2, thereby enabling efficient lubrication of both the transmission gear groups meshing with each other in multiple stages.

As mentioned above, the starter motor 50 as described above is mounted onto the upper unit case 11U of a structure with a reduced front-to-rear width in which the main shaft 61 is arranged above the space between the crankshaft 10 and the counter shaft 65, and in which the transmission case 11*m* is raised so as to accommodate the group of transmission gears m1 to m6 on the main shaft 61.

The starter motor 50 is suspended in the narrow V-shaped space formed by the rear inclined surface 12*s* of the cylinder block portion 12 and the front wall surface 11*s* of the raised portion 11*a*, of the upper unit case 11U having a reduced front-to-rear width to achieve a reduction in the size of the internal combustion engine E.

That is, the starter motor 50 is mounted to the upper unit case 11U in such a way that the bearing cylinder portion 50*b* at the right end is fitted in the circular hole 11*d* of the left wall 11*c* of the enlarged portion 11*b*, the front bracket 52*f* of the mounting member 52 at the left end is fastened to the front mounting boss 12*f* formed in the rear inclined surface 12*s* of the cylinder block portion 12, and the rear bracket 52*r* is fastened to the rear mounting boss 11*r* formed in the front wall surface 11*s* of the raised portion 11*a*.

As shown in FIG. 3, the front mounting boss 12*f*, which is formed in the rear inclined surface 12*s* of the cylinder block portion 12 and to which the mounting member 52 at the left end of the starter motor 50 is mounted, and the rear mounting boss 11*r* formed in the front wall surface 11*s* of the raised portion 11*a* are positioned on the right and left of the cylinder center axis X-X' and offset from each other in the crankshaft direction (left-to-right direction). It is thus possible to secure a large distance between the front mounting boss 12*f* and the rear mounting boss 11*r* even when the V-shaped space S in which the starter motor 50 is mounted is narrow.

In the above-mentioned V-shaped space S that is narrowly defined for achieving a reduction in the size of the internal combustion engine, the front bracket 52*f* and the rear bracket 52*r* that extend from the mounting member 52 of the starter motor 50 are respectively fastened to the front mounting boss 12*f* and the rear mounting boss 11*r* that are formed at a suitably large spacing from each other. A high mounting rigidity is thus secured, and the influence of vibration acceleration exerted on the starter motor 50 by the vibration of the internal combustion engine is reduced, thereby making it possible to enhance the durability of the starter motor 50.

Further, the front mounting boss 12*f* is formed at a position that is offset to the right side in the crankshaft direction with respect to the cylinder center axis X-X', which means that the front mounting boss 12*f* is formed at a location with the highest rigidity which corresponds to the connecting portion between the cylinder bores 12*c*, 12*c* and where a stud bolt for fastening the cylinder head 13 to the cylinder block portion 12 or the like is arranged, thereby making it possible to enhance the rigidity of the front mounting boss 12*f* itself Further, the front mounting boss 12*f* can be formed so as to be positioned further forward while avoiding the cylinder bore 12*c*, that is, so as to be positioned as far forward as possible from the rear mounting boss 11*r*, thereby making it possible to secure higher mounting rigidity by increasing the distance between the front mounting boss 12*f* and the rear mounting boss 11*r*.

As shown in FIG. 3, the rear mounting boss 11*r* is formed on the leftmost side in the front wall surface 11*s* of the raised portion 11*a* of the transmission case 11*m*. This location corresponds to a position substantially in front of the second transmission gear m2 located on the leftmost side from among the group of transmission gears m1 to m6 journalled to the main shaft 61 inside the transmission chamber M.

Since the gear ratio between the intermeshing second transmission gears m2, n2 is large, and hence the diameter of the second transmission gear m2 is small, the rear mounting boss 11*r* can be formed so as to be positioned further rearward in proximity to the second transmission gear m2 having a small diameter, that is, so as to be positioned as far rearward as possible from the front mounting boss 12*f*, thereby making it possible to further increase the distance between the front mounting boss 12*f* and the rear mounting boss 11*r* to secure higher mounting rigidity.

At the time of mounting the main shaft 61 and the transmission gears m1 to m6, these components are mounted from the right side by being inserted from a bearing opening in the right wall of the transmission case 11*m* of the upper unit case 11U. Therefore, no interference occurs between the transmission gear m6 or the like, which is larger in diameter than the transmission gear m2 located on the leftmost side, and the rear mounting boss 11*r* located at a position substantially in front of the second transmission gear m2.

Further, as shown in FIG. 6, the rear mounting boss 11*r* is formed in the upwardly extending portion of the partition wall 21 partitioning between the crank chamber C and the transmission chamber M of the upper unit case 11U. The rigidity of the rear mounting boss 11*r* itself can be thus made high, and the influence of vibration of the internal combustion engine on the starter motor 50 can be reduced to achieve enhanced durability of the starter motor 50.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. In an internal combustion engine of the type including a crankcase for accommodating a crank mechanism and a transmission case for accommodating a transmission mechanism, where the crankcase and the transmission case are integrated in a power unit case, the improvement comprising a starter-motor mounting structure for supporting a starter motor on the power unit case, in which the crankcase and the transmission case are arranged in a front-to-rear direction, wherein:

the power unit case comprises a cylinder block that projects from the crankcase so as to be tilted forward, the cylinder block having a rear inclined surface with a front mounting boss formed thereon;

the power unit case also comprises a transmission case having an upper wall which is raised upwardly to accommodate a main shaft that is positioned higher than a counter shaft of the transmission mechanism, the upper wall having a rear mounting boss formed in a front wall surface of a raised portion of the upper wall of the transmission case;

wherein the front mounting boss and the rear mounting boss are offset from each other in an axial crankshaft direction; and a front bracket and a rear bracket that extend from the starter motor are respectively fastened to the front mounting boss and the rear mounting boss.

2. The starter-motor mounting structure for an internal combustion engine according to claim 1, wherein the front mounting boss is situated at a position offset from a cylinder center axis in the crankshaft direction.

3. The starter-motor mounting structure for an internal combustion engine according to claim 1, wherein a group of gears is accommodated in the raised portion of the upper wall of the transmission case, wherein said group of gears includes a plurality of gears of different diameters arranged on the main shaft inside the transmission case; and wherein the rear mounting boss is formed at a position substantially opposite a small-diameter gear of said group of gears.

4. The starter-motor mounting structure for an internal combustion engine according to claim 1, wherein the rear mounting boss is formed in an upwardly extending portion of a partition wall that partitions between a crank chamber inside the crankcase and a transmission chamber inside the transmission case.

* * * * *